US009931667B2

(12) United States Patent
Kalwa

(10) Patent No.: US 9,931,667 B2
(45) Date of Patent: Apr. 3, 2018

(54) METHOD FOR PRINTING A WOOD MATERIAL BOARD AND WOOD MATERIAL BOARD WITH PRINTED DECORATIVE LAYER

(71) Applicant: Flooring Technologies Ltd., Pieta (MT)

(72) Inventor: Norbert Kalwa, Horn-Bad Meinberg (DE)

(73) Assignee: Flooring Technologies Ltd., Kalkara (MT)

( * ) Notice: Subject to any disclaimer, the term of this patent is extended or adjusted under 35 U.S.C. 154(b) by 0 days.

(21) Appl. No.: 14/200,588

(22) Filed: Mar. 7, 2014

(65) Prior Publication Data

US 2014/0255670 A1 Sep. 11, 2014

(30) Foreign Application Priority Data

Mar. 8, 2013 (EP) ..... 13158397

(51) Int. Cl.

*B05D 7/08* (2006.01)
*B41M 5/00* (2006.01)
*B41M 7/00* (2006.01)

(52) U.S. Cl.

CPC ..... *B05D 7/08* (2013.01); *B41M 5/0047* (2013.01); *B41M 5/0076* (2013.01); *B41M 7/0036* (2013.01); *B41M 7/0045* (2013.01); *Y10T 428/24884* (2015.01)

(58) Field of Classification Search

CPC ..... Y10T 428/24884
See application file for complete search history.

(56) References Cited

U.S. PATENT DOCUMENTS 8,328,303 B2 12/2012 Frati
8,424,264 B2 4/2013 Coghlan et al.
2002/0014297 A1* 2/2002 Mott ..... B32B 5/20 156/78
2003/0203213 A1* 10/2003 Woo et al. ..... 428/422.8
2004/0086678 A1 5/2004 Chen et al.
(Continued)

FOREIGN PATENT DOCUMENTS

EP 1872959 A1 1/2008
EP 2314462 A1 4/2011
(Continued)

OTHER PUBLICATIONS

"A Method of Manufacturing a Panel", ip.com Journal, Sep. 24, 2012.

*Primary Examiner* — Gerard Higgins
*Assistant Examiner* — Sathavaram I Reddy
(74) *Attorney, Agent, or Firm* — The Webb Law Firm

(57) ABSTRACT

Disclosed is a method for printing a wood material board, in particular a wood fiber material board, by means of a digital printing process. The method includes the steps of (a) printing at least one side of a wood material board by means of digital printing technology, forming a decorative layer; (b) applying a protective layer containing at least one resin, at least one radiation-curable varnish and/or at least one polyurethane to the decorative layer of the wood material board; and (c) pre-drying and/or pre-gelling the protective layer applied to the decorative layer of the wood material board.

12 Claims, 1 Drawing Sheet

(56) References Cited

U.S. PATENT DOCUMENTS

| | | | | |
|---|---|---|---|---|
| 2004/0126602 | A1* | 7/2004 | Wallner | C04B 28/02 428/500 |
| 2004/0191547 | A1* | 9/2004 | Oldorff | 428/479.3 |
| 2008/0241399 | A1* | 10/2008 | Wilkins et al. | 427/292 |

FOREIGN PATENT DOCUMENTS

| | | | |
|---|---|---|---|
| EP | 2484539 | A1 | 8/2012 |
| WO | 2006031951 | A1 | 3/2006 |
| WO | 2011020755 | A1 | 2/2011 |

* cited by examiner

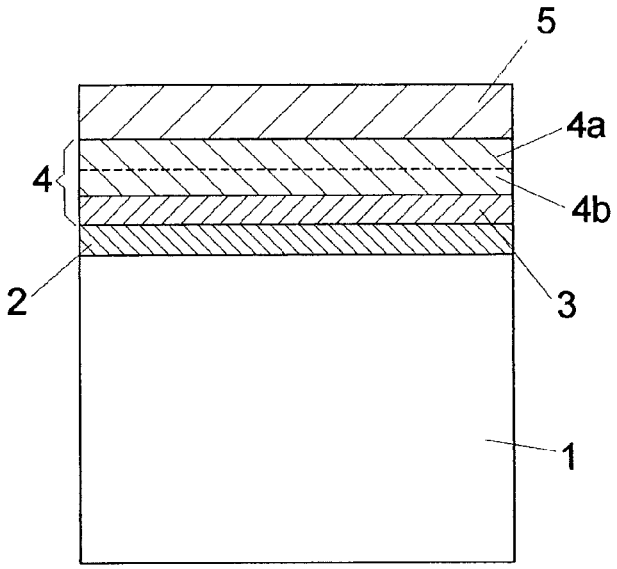
5
4a
4
4b
2
3
1

METHOD FOR PRINTING A WOOD MATERIAL BOARD AND WOOD MATERIAL BOARD WITH PRINTED DECORATIVE LAYER

CROSS-REFERENCE TO RELATED APPLICATION

This application claims priority to European Patent Application No. 13 158 397.3 filed Mar. 8, 2013, the disclosure of which is hereby incorporated in its entirety by reference.

BACKGROUND OF THE INVENTION

Field of the Invention

The present invention relates to a method for printing a wood material board and to a wood material board with a printed decorative layer.

Description of Related Art

The use of wood material boards in the furniture industry, as floor coverings or else for cladding walls and ceilings requires machining or finishing the surface of the wood material boards. Normally, in the areas of application mentioned, the wood material boards are coated with a decorative paper. No limits are placed on the variety of variously patterned decorative papers, so that wood material boards having a multiplicity of different decorations, such as stone or wood decorations, can be obtained.

As an alternative to the use of decorative papers on wood material boards, in the past the direct printing of wood material boards has been developed, since the printing of paper and the subsequent lamination or direct coating of the latter onto the wood material board is dispensed with.

The printing techniques primarily used in this case are the gravure printing process and the digital printing process. The gravure printing process is a printing technique in which the elements to be depicted are present as depressions in a printing form, which is inked before the printing. The printing ink is primarily located in the depressions and is transferred to the object to be printed on the basis of contact pressure of the printing form and of adhesive forces. In the case of digital printing, on the other hand, the printing image is transferred directly from a computer into a printing machine, such as a laser printer or inkjet printer. The use of a static printing form is dispensed with.

However, it is possible to foresee that the gravure printing technology will be displaced to an ever greater extent by the digital printing technology. From a cost point of view, this is based on the considerable reduction in costs for digital printers and digital printing inks and, in particular from a technological point of view, on the very great flexibility and the styling possibilities of the digital printing technique, in particular taking into account the trends to increasingly smaller batch sizes.

However, some problems still stand in the way of the complete conversion from gravure printing to digital printing.

Firstly, the production speed of a digital printer is still considerably below that of a modern varnishing line or short-cycle press. These are usually the next value creation stages after the digital printing.

Secondly, there is frequently incompatibility between the digital printing inks used, which can be implemented on a water base, on a UV base or on a solvent base, and the layers to be applied subsequently for the purpose of sealing and for wear protection.

A further aspect is that, during the transport and/or the handling of boards with unprotected decorative prints on the upper side in a production chain, contamination and/or damage to the decoration has to be taken into account. This leads to a reduction in quality but can often only be identified late in the production chain, so that a great deal of effort and high costs follow.

When the gravure printing technique is used in wood material boards based on aqueous printing inks with subsequent finishing by means of varnishing, these problems are obviously not posed, since no productivity differences between printing and varnishing exist and therefore intermediate storage or transport is dispensed with.

The problem already exists in somewhat more pronounced form in the use of wood material boards decorated by gravure printing which are subsequently to be coated with wear protection in a short-cycle press. Here, the productivity of the printing line is already considerably above that of the short-cycle press. Surface protection for transport and/or intermediate storage is therefore absolutely necessary. Such a surface protection is normally applied via a roll application and comprises a formulation which consists of a thermosetting resin, for example melamine resin. In this case, barely any adhesion problems occur, so that technologically there are barely any restrictions.

In the case of a digital print, this is far more complex and more difficult. After the decision for an ink system has been made (e.g. UV-based digital printing ink), in addition to the aforementioned productivity restrictions, in particular incompatibilities in specific processing lines occur. For example, when UV-based digital printing inks are used, subsequent coating with aqueous melamine resins is difficult, which means that further processing in a short-cycle press by using this thermosetting resin generates high technical hurdles.

There is a great need for a technical solution which does not restrict or make more difficult the process steps following the printing operation for the further processing or finishing of wood materials.

SUMMARY OF THE INVENTION

The present invention is therefore based on the object of improving the digital printing process for wood material boards to such an extent that transport and handling of decorated boards is possible without quality losses and, at the same time, restrictions in the further processing are largely overcome.

According to an exemplary embodiment of the invention, a method for printing a wood material board, in particular a wood fiber material board, by means of a digital printing process is provided, comprising the following steps:

a) printing at least one side of a wood material board by means of digital printing technology, forming a decorative layer;

b) applying a protective layer containing at least one resin, at least one radiation-curable varnish and/or at least one polyurethane to the decorative layer or printed side of the wood material board; and c) pre-drying and/or pre-gelling the protective layer applied to the decorative layer of the wood material board.

Accordingly, the present method provides a protective layer on a digitally printed wood material board, which layer, at the same time, is arranged as a promoter, what is known as a primer, between intrinsically incompatible layers, such as the decorative print or the decorative layer, on the one hand, and a subsequent wear protection or other finishing layers, on the other hand. Furthermore, the protective layer is only pre-dried and/or pre-gelled and is thus not yet completely dried or cured. The surface of the protective layer is rather sticky or surface-dried. The pre-drying and/or pre-gelling is carried out to the extent that the protective layer i.e. the resin or varnish as such is still free-flowing and cross-linkable. The pre-drying and/or pre-gelling can thus also be described as a pre-crosslinking or a pre-polymerisation.

The present method has a number of advantages. Thus, depending on the type of further processing, a protection and primer system matched thereto is used. In the present case, either a resin, preferably a water-compatible resin, a radiation-curable, typically not water-compatible, varnish, or else polyurethanes, which have good adhesive properties, can be applied directly to the digital print. Following pre-curing or pre-gelling of the protective layer, intermediate storage of the printed boards is possible without any danger of surface damage to or contamination of the decorative layer. Thus, even in the event of undefined time intervals between a digital decorative printing processing step and a further processing step, no problems are to be expected, such as sticking of boards or abrasion and/or separation of the decoration. It is therefore also ensured that, in the event of an operating interruption in the further processing, the digital printer does not have to suspend its work.

The present method opens up the possibility of being able to operate the various further finishing systems, so that the digital printing can be used for a wider range of products, e.g. varnished furniture fronts, laminated floors, facade boards.

Thus, during the production of products for use indoors, such as furniture, floors, panels and so on, a water-compatible resin can be used as protective layer on water-based inks, since the finishing layer or wear layer that may be provided is normally a coating made of an aminoplastic resin, such as a melamine-formaldehyde resin.

However, even in the aforementioned applications for indoors, radiation-curable varnishes can be planned as a finishing layer or wear layer. In such a case, the use of a radiation-curable varnish as a protective layer would be expedient.

In the case of outdoor applications, such as facades, street furniture, advertising hoardings and so on, radiation-curable varnishes and polyurethanes on UV or latex inks would primarily be used.

Of course—depending on the intended use—still further primer/protective layers can also be used. This depends on the further finishing steps and materials which are to be applied to the print.

In addition, for specific applications (e.g. outdoor applications), latex or solvent inks can be used. Here, too, by means of a clever choice of the primer/protective layer, transport/storage without damage or loss of quality can be ensured. Furthermore, coating with "any desired" materials in order to achieve desired properties for use is made possible.

In one exemplary embodiment of the present method, before the printing, at least one priming layer comprising at least one resin and/or at least one varnish is applied to the side of the wood material board that is to be printed, and is subsequently pre-dried and/or pre-cured.

Here, an aqueous resin solution and/or a radiation-curable mastic compound is preferably used for the priming on the side of the wood material board that is to be printed.

In the case of the pre-coating or priming of the wood material board with an aqueous resin solution, an aqueous formaldehyde-containing resin solution, in particular an aqueous solution of a melamine-formaldehyde resin, urea-formaldehyde resin or melamine-urea-formaldehyde resin can be used.

The application quantity of liquid resin solution for priming can be between 10 and 80 g/m$^2$, preferably 20 and 50 g/m$^2$. The solids content of the aqueous resin solution lies between 30 and 80%, preferably 40 and 60%, in particular at 55%. The liquid resin can additionally have suitable wetting agents, hardeners, release agents and defoamers.

Following application of the aqueous resin solution to the wood material board for the pre-coating or priming of the same, the liquid resin is dried to a moisture content of 10%, preferably 6%, for example in a convection oven or near-infrared oven.

In another exemplary embodiment of the present method, the wood material board can be pre-coated or primed with UV mastic and/or ESH mastic. A UV-mastic compound is advantageously substantially composed of UV-curable varnish components, pigments, reactive thinners and reactant generators as chain starters.

The application quantity of the mastic compound in this case can be 50 to 150 g/m$^2$, preferably 50 to 100 g/m$^2$.

Here, the quantities stated refer to a 100% mastic compound.

Likewise, it is possible that the mastic compound used for the priming is present in pigmented form, by which means the printed result can be varied or improved.

It is also preferred to apply the mastic compound in a number of layers. In this case, between the applications, pre-curing of the individual layers by means of UV or ESH radiation can be carried out. It is also possible, following each application and subsequent pre-curing, to perform intermediate grinding, in order to improve the surface finish of the side of the wood material board that is to be printed.

In a further exemplary embodiment of the present method, before the printing of the at least one side of the wood material board, at least one layer of a water-based, pigmented printing ink is applied to the side of the wood material board that is to be printed. The printing ink can either be applied directly to the untreated surface of the wood material board or else to the primer.

The water-based pigmented printing ink can also be applied in more than one layer (e.g. 3 to 10 layers, preferably 5 to 8 layers), the printing ink being dried after each layer application, for example in a convection dryer or near-infrared dryer.

In the following digital printing, a water-based digital printing ink is preferably used to print the at least one side of the wood material board. The digital printing can be carried out by using a digital printer with a water-based digital printing ink. The quantity of digital printing ink used can be between 5 and 10 g/m$^2$, preferably 6 and 8 g/m$^2$.

As mentioned above, a protective layer containing at least one resin, at least one radiation-curable varnish and/or at least one polyurethane is applied to the printed side or decorative layer of the wood material board.

In one exemplary embodiment, the protective layer to be applied to the decorative layer of the wood material board comprises at least one water-compatible resin, preferably a formaldehyde-containing resin, in particular preferably melamine-formaldehyde resin, urea-formaldehyde resin and/or melamine-urea-formaldehyde resin. Accordingly, the resin can be applied in liquid form or else in solid form, the use of a liquid resin being preferred.

Next, the protective layer comprising the at least one water-compatible resin is pre-dried until the resin is still free-flowing and cross-linkable. The pre-drying of the protective layer containing a water-compatible resin is typically carried out in a continuous drying oven, such as is known from wood material board production. Depending on the application quantity, the drying process can last for 5 to 15 seconds, preferably 5 to 10 seconds.

In another exemplary embodiment of the present method, the protective layer to be applied to the printed side of the wood material board or decorative layer comprises at least one radiation-curable varnish chosen from the group of acrylates, modified acrylates and/or epoxies.

In one exemplary embodiment, the acrylate is present in the form of a substituted or non-substituted monomer, oligomer and/or polymer, in particular in the form of an acrylic acid, acrylic ether and/or acrylic acid ester monomer. Of importance for the present method is the presence by definition of a double bond or unsaturated group in the acrylate molecule. The polyacrylates can also be present in further functionalized form. Suitable functional groups are, amongst others, hydroxy, amino, epoxy and/or carboxyl groups. Preferred acrylates are polyester acrylates, polyether acrylates, urethane acrylate, hexane dioldiacrylate or mixtures thereof.

The acrylate compound can be present and used both in the form of an emulsion or dispersion. The acrylate dispersion used can be produced by mixing the at least one acrylate with water and/or a further organic liquid. Preferably, however, the acrylate varnishes used in the present case contain no solvent or other additives and are thus present as 100% systems.

The epoxy-containing varnishes used can be epoxy resins, epoxy-functional pre-polymers, cycloaliphatic epoxies.

In a still further exemplary embodiment, the protective layer to be applied to the printed side of the wood material board comprises at least one polyurethane chosen from the group containing aliphatic urethanes. The latter are characterized by high light-fastness.

Likewise, in a further exemplary variant of the present method, it is possible for the protective layer to be applied to the printed side of the wood material board to comprise a mixture of at least one radiation-curable varnish and at least one polyurethane.

In such a case, the polyurethane used in the mixture can be viewed as a primer for improving the adhesion of the UV varnish to the digital print.

Accordingly, it is generally desirable, when using UV varnish as a radiation-curable varnish, to add a primer to the same in order to improve the adhesion of the UV varnish to the digital print. In addition to the polyurethanes already mentioned as primers, silanes can likewise be used as primers.

If a radiation-curable varnish is used as protective layer, the pre-gelling of the protective layer, following the application of the protective layer, can be carried out by using UV radiation (e.g. at 320-400 nm), ESR radiation and/or NIR radiation. Following the pre-gelling, the varnish preferably has a degree of polymerization between 20-60%, preferably 30-50%.

In a further-reaching variant of the present method, the protective layer to be applied to the printed side of the wood material board is applied in a quantity between 5 and 50 $g/m^2$, preferably 8 and 30 $g/m^2$, in particular preferably 10 and 20 $g/m^2$.

In another exemplary variant of the present method, first of all a first protective layer comprising at least one radiation-curable varnish and/or at least one polyurethane is applied to the printed side of the wood material board and is pre-gelled, and then at least one second protective layer made of at least one water-compatible resin, preferably of a formaldehyde-containing resin, is applied to the pre-gelled first protective layer comprising at least one radiation-curable varnish and/or at least one polyurethane, and is then preferably pre-dried, as already described.

In a further exemplary embodiment of the present method, the wood material board printed and provided with a protective layer is processed further or finished in a short-cycle press. In the short-cycle press, the resin layers are fused and the layer composite is cured to form a laminate. During the further processing in the short-cycle press, by using a structured press platen, surface structures, which optionally can also be implemented in a manner coordinated with the decoration (so-called decoration-synchronous structure) can also be produced in the surface of the wood material board. In the case of wooden decorations, the structures can be present in the form of pore structures which follow the grain. In the case of tile decorations, the structures can be depressions in the area of joint filling lines comprised by the decoration.

It is likewise possible, following the pre-drying and/or pre-gelling of the protective layer applied to the printed side of the wood material board according to step c), to apply at least one further layer comprising abrasion-resistant particles, natural fibers, synthetic fibers and/or further additives, it being possible to use melamine resins, acrylic resins and polyurethane resins as suitable binders.

The abrasion-resistant particles are preferably chosen from the group containing aluminum oxide, corundum, boron carbide, silicon dioxide, silicon carbide and glass spheres. Suitable for use as natural and/or synthetic fibers are in particular fibers chosen from the group containing wood fibers, cellulose fibers, wool fibers, hemp fibers and organic or inorganic polymer fibers.

As additives, conductive substances, flame prevention agents, luminescent substances and metals can be added. Here, the conductive substances can be chosen from the group containing carbon black, carbon fibers, metal powders and nanoparticles, in particular carbon nanotubes. It is also possible for combinations of these substances to be used. The flame prevention agents used are preferably phosphates, borates, in particular ammonium polyphosphate, tris(tribromo-neopentyl) phosphate, zinc borate or boric acid complexes of multivalent alcohols. Luminescent substances are preferably fluorescent and/or phosphorescent substances on an inorganic or organic basis, in particular zinc sulfide and alkaline earth aluminates.

In principle, the wood material board to be printed can be composed of a wood material or of plastic or a wood material-plastic mixture. Use is preferably made of chipboard, medium density fiber boards, high density fiber boards or oriented strand boards or plywood boards, a cement fiber board and/or plaster fiber board.

The present method permits the production of a wood material board having the following structure

- optionally at least one priming layer on at least one side of the wood material board;
- at least one decorative layer applied to the priming layer by means of digital printing; and
- at least one, in particular pre-dried and/or pre-gelled, protective layer applied to the decorative layer, containing at least one resin, at least one radiation-curable varnish and/or at least one polyurethane.

In one exemplary variant, the protective layer of the present wood material board is composed of at least one first protective layer comprising at least one radiation-curable varnish and/or at least one polyurethane, and a second protective layer comprising at least one resin, applied to the first protective layer.

Following a subsequent finishing process of the printed wood material board, the latter can additionally have a layer comprising abrasion-resistant particles, natural fibers, synthetic fibers and/or further additives, applied to the at least one protective layer.

Opposite the printed side, i.e. on the reverse side, the wood material board can have at least one counterbalancing coating and/or a sound-damping layer.

BRIEF DESCRIPTION OF THE DRAWING

The invention will be explained in more detail on the basis of a number of exemplary embodiments, with reference to the FIGURES of the drawing, in which:

FIG. 1 shows a perspective view of a cross section of a printed wood material board according to one embodiment.

DETAILED DESCRIPTION OF THE INVENTION

FIG. 1 shows the cross section of a wood material board printed by means of the present method. Firstly, a priming layer 2 made of an aqueous resin solution or a curable mastic compound was applied to the upper side of the wood material board 1, in order to eliminate irregularities in the surface of the wood material board and to provide an improved surface for the subsequent digital printing.

The decorative layer 3 is then printed onto the priming layer 2, and is subsequently provided with a protective layer 4 made of a water-compatible resin or a radiation-curable varnish. In general, it is also possible for the protective layer 4 to be composed of a first partial layer 4*a* in the form of a radiation-curable varnish and a second partial layer 4*b* in the form of a water-compatible resin, which have been applied to the decorative layer 3 one after the other with intermediate drying.

The protective layer 4 is adjoined by a wear layer 5, which consists of a binder and abrasion-resistant particles.

Exemplary Embodiment 1

An HDF board (fiber board with increased bulk density) is firstly pre-coated with an aqueous synthetic resin (melamine-formaldehyde resin). The application quantity is around 20-50 g liquid resin/m$^2$ (solids content: about 55%). The resin contains the usual additives such as wetting agents, hardeners, release agents and defoamers. After that, the applied resin is dried to a moisture content of about 6% in a convection dryer or a near-infrared oven. Then, a plurality of layers of a water-based, pigmented primer is applied (5-8×). After each application, the primer is dried with the aid of a convection dryer or a near-infrared dryer. The primed board is then printed with a motif by using a digital printer. About 6-8 g/m$^2$ of water-based digital printing ink are used.

Primer/Protective Alternative 1*a*

A layer of melamine-formaldehyde resin is then applied and pre-dried as already described above. The pre-drying is carried out only up to the point at which the resin is still free-flowing and cross-linkable. As a result, sticking of the resin-coated boards is prevented. As a result of the incomplete cross-linking of the synthetic resin, it is also ensured that an application of further liquid or powdery resin layers (e.g. melamine resin) or resin-impregnated papers and subsequent pressing in short-cycle further processing is possible without any impairment to the adhesion of the layers subsequently applied taking place. The application quantities of the resins (liquid, powdery or on paper) can quite possibly be several hundred grams, depending on the desired structure and structure depth. As mentioned, the boards treated in this way can be fed to a short-cycle press for further processing.

Primer/Protective Alternative 1*b*

A layer based on UV varnishes (1- or 2-component) or polyurethane or mixtures thereof is applied to the digital print, by which means the adhesion to the printing ink and to the further layers is improved, and which layer serves as a protective layer. Any other desired primers can likewise be used, however. The combined protective and primer layer is applied in a quantity of 8-30 g primer/m$^2$. The primer can be pre-gelled by a UV lamp, an ESH emitter or NIR. After that, the boards can be stacked and can subsequently be further processed. This can be done, for example, by means of the application of a plurality of layers of UV or ESH varnishes, which, as individual functional layers, prevent the tendency to wear or scratching. The boards treated in this way can then be fed to a short-cycle press for further processing and finishing.

Exemplary Embodiment 2

An HDF board (fiber board with increased bulk density) is firstly pre-coated with a UV or ESH mastic. The application quantity is around 50-100 g varnish/m$^2$ (100%). The UV/ESH mastic is pigmented and can be applied in a plurality of layers. In each case, drying with the aid of UV or ESH emitters is carried out between the individual applications. If required, after each application/curing, intermediate grinding is carried out. The primed board is then printed with a motif by using a digital printer. About 6-8 g/m$^2$ UV digital printing ink is used.

Primer/Protective Alternative 2*a*

A primer based on UV varnishes (1- or 2-component) or polyurethane or mixtures thereof is applied to the digital print, which improves the adhesion to the printing ink and to the further layers and serves as a protective layer. Any other primers desired can likewise be used, however. The combined protective and primer layer is applied in a quantity of 8-30 g primer/m$^2$. The primer can be pre-gelled by means of a UV lamp, an ESH emitter or NIR. After that, the boards can be stacked and can subsequently be further processed. A layer of melamine-formaldehyde resin is then applied and pre-dried as already described above. The pre-drying is carried out only up to the point at which the resin is still free-flowing and cross-linkable. As a result of the incomplete cross-linking of the synthetic resin, it is ensured that an application of further liquid or powdery resin layers (e.g. melamine resin) or resin-impregnated papers and subsequent pressing in short-cycle further processing is possible without any impairment to the adhesion of the layers subsequently applied taking place. The application quantities of the resins (liquid, powdery or on paper) can quite possibly be several hundred grams, depending on the desired structure and structure depth.

Primer/Protective Alternative 2*b*

Applied to the digital print, for example, is a UV varnish which contains a primer that improves the adhesion to the printing ink and to the further layers. In addition, the primer is also intended to prevent the occurrence of gas bubbles. These frequently occur during the direct application of a varnish to the UV ink. Surprisingly, this no longer occurs after the primer application. The combined protective and primer layer is applied in a quantity of 8-30 g primer/$m^2$. This can be, for example, a primer based on a polyurethane. Any other desired primers can likewise be used, however. The varnish can be pre-gelled by a UV lamp or ESH emitter. After that, the boards can be stacked and can subsequently be further processed. This can be done, for example, by means of the application of a plurality of layers of UV or ESH varnishes, which, as individual functional layers, prevent the tendency to wear or scratching. The boards treated in this way can then be fed to a short-cycle press for further processing and finishing.

The invention claimed is:

1. A method for printing a wood material board by means of a digital printing process, comprising the steps of:

a) applying at least one pre-coating or priming layer comprising at least one aqueous resin solution to at least one side of the wood material board that is to be printed, wherein the aqueous resin solution has a solid content between 30 and 80% by weight based upon total weight of the aqueous resin solution and is applied in an amount of between 10 and 80 g/$m^2$, and after application is dried to a moisture content of 10% or less;

b) applying at least one layer of water-based pigmented primer that is dried after application;

c) printing the at least one side of the wood material board by means of digital printing technology, forming a decorative layer, wherein the amount of digital printing ink used is between 5 and 10 g/$m^2$;

d) applying a protective layer containing at least one resin to the decorative layer, wherein the amount of protective layer applied is between 5 and 50 g/$m^2$; and e) pre-drying the protective layer applied to the decorative layer, wherein the protective layer is pre-dried to the extent that it is still free-flowing and cross-linkable, such that intermediate storage of the printed board is possible before application of further wear protection or other finishing layers and such that the protective layer acts as a primer between incompatible layers, wherein the pre-drying of the at least one resin used as the protective layer is performed for 5 to 15 seconds depending on the application quantity.

2. The method as claimed in claim 1, wherein, the at least one pre-coating or priming layer further comprises at least one radiation-curable mastic compound.

3. The method as claimed in claim 1, wherein, before the printing of the at least one side of the wood material board, at least one layer of a water-based, pigmented printing ink is applied to the at least one side of the wood material board that is to be printed.

4. The method as claimed in claim 1, wherein a water-based digital printing ink is used to print the at least one side of the wood material board.

5. The method as claimed in claim 1, wherein the at least one resin, which forms the protective layer to be applied to the decorative layer of the wood material board comprises at least one water-compatible resin.

6. The method as claimed in claim 1, wherein the protective layer to be applied to the decorative layer of the wood material board further comprises at least one radiation-curable varnish chosen from the group of acrylates, modified acrylates, epoxies, and mixtures thereof.

7. The method as claimed in claim 1, wherein the protective layer to be applied to the decorative layer of the wood material board further comprises at least one polyurethane containing an aliphatic urethane.

8. The method as claimed in claim 7, wherein the protective layer to be applied to the decorative layer of the wood material board comprises a mixture of at least one radiation-curable varnish and the at least one polyurethane.

9. The method as claimed in claim 1, wherein the protective layer further comprises at least one radiation-curable varnish and/or at least one polyurethane and step e) is followed by the application and pre-drying of at least one second protective layer made of at least one water-compatible resin that is applied to the pre-gelled protective layer.

10. The method as claimed in claim 1, wherein the wood material board printed and provided with a protective layer is fed to a short-cycle press for further processing.

11. The method as claimed in claim 1, wherein the protective layer applied is between 8 and 30 g/$m^2$.

12. The method as claimed in claim 1, wherein the protective layer applied is between 10 and 20 g/$m^2$.

* * * * *